US008006973B2

(12) United States Patent
Toba et al.

(10) Patent No.: US 8,006,973 B2
(45) Date of Patent: Aug. 30, 2011

(54) REPLACEABLE UNIT, SHEET CONVEYANCE APPARATUS AND IMAGE FORMING DEVICE

(75) Inventors: Takakiyo Toba, Kanagawa (JP); Kouta Tanaka, Kanagawa (JP); Nobutoshi Hamasaki, Kanagawa (JP); Hiroatsu Kazama, Kanagawa (JP); Takuya Ito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 275 days.

(21) Appl. No.: 12/060,599

(22) Filed: Apr. 1, 2008

(65) Prior Publication Data

US 2009/0072469 A1 Mar. 19, 2009

(30) Foreign Application Priority Data

Sep. 14, 2007 (JP) ..... 2007-239172

(51) Int. Cl.
*B65H 5/00* (2006.01)

(52) U.S. Cl. ..... 271/10.09; 271/10.11; 271/117

(58) Field of Classification Search ..... 271/10.01, 271/10.09, 10.11, 109, 117
See application file for complete search history.

(56) References Cited

U.S. PATENT DOCUMENTS

| | | | | |
|---|---|---|---|---|
| 5,421,569 | A * | 6/1995 | Davidson | 271/109 |
| 6,565,077 | B2 * | 5/2003 | Kawada | 271/10.03 |
| 2003/0184000 | A1 * | 10/2003 | Kim | 271/10.11 |

FOREIGN PATENT DOCUMENTS

| | | | |
|---|---|---|---|
| JP | 63-074835 | A | 4/1988 |
| JP | 3-21038 | U | 3/1991 |
| JP | 3-110044 | U | 11/1991 |
| JP | 10-025033 | A | 1/1998 |
| JP | 10-236689 | A | 9/1998 |
| JP | 11-334904 | A | 12/1999 |
| JP | 2000-085994 | A | 3/2000 |
| JP | 2002-179276 | A | 6/2002 |
| JP | 2005-194023 | A | 7/2005 |

* cited by examiner

*Primary Examiner* — David H Bollinger
(74) *Attorney, Agent, or Firm* — Sughrue Mion, PLLC

(57) ABSTRACT

A replaceable unit includes a feeding roller that feeds a sheet from a sheet accommodation portion that accommodates the sheet; a conveyance roller that conveys the sheet fed by the feeding roller downstream; a first frame body that supports the feeding roller and the conveyance roller so as to be rotatable; and a second frame body that supports the first frame body so as to be movable and is removably mounted at a position at which the feeding roller can touch against the sheet accommodated at the sheet accommodation portion.

17 Claims, 9 Drawing Sheets

REPLACEABLE UNIT, SHEET CONVEYANCE APPARATUS AND IMAGE FORMING DEVICE

CROSS-REFERENCE TO RELATED APPLICATION

This application is based on and claims priority under 35 USC 119 from Japanese Patent Application No. 2007-239172, filed Sep. 14, 2007.

BACKGROUND OF THE INVENTION

1. Technical Field

The present invention relates to a replaceable unit, a sheet conveyance device and an image forming apparatus 2. Related Art A Sheet conveyance device with a structure in which removal of a feeding roller and auxiliary feeding roller is performed by undoing a bolt and displacing a block frame is known.

SUMMARY

A replaceable unit of a first aspect of the present invention includes a feeding roller that feeds a sheet from a sheet accommodation portion that accommodates the sheet; a conveyance roller that conveys the sheet fed by the feeding roller downstream; a first frame body that supports the feeding roller and the conveyance roller so as to be rotatable; and a second frame body that supports the first frame body so as to be movable and is removably mounted at a position at which the feeding roller can touch against the sheet accommodated at the sheet accommodation portion.

According to the replaceable unit of the first aspect, the first frame body is displaced relative to the second frame body at the time of an operation of replacement of the replaceable unit, and thus the operation of replacement of the replaceable unit can be simplified compared to a structure in which the first frame body is not displaced.

BRIEF DESCRIPTION OF THE DRAWINGS

Exemplary embodiments of the present invention will be described in detail based on the following figures, wherein.

DESCRIPTION

Herebelow, an example of the exemplary embodiment relating to the present invention will be described with reference to the drawings.

Figure 1:
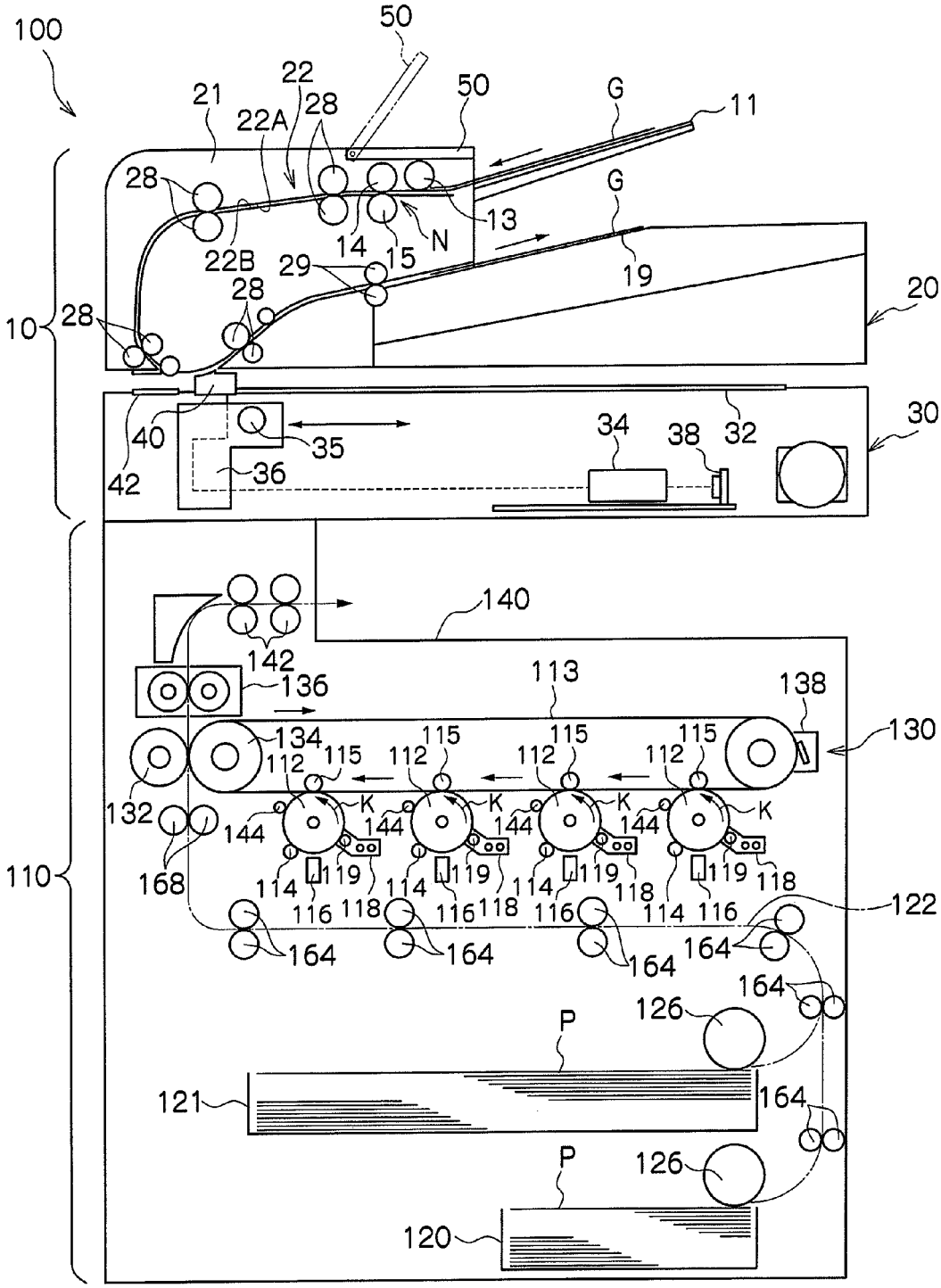
FIG. 1 is a schematic diagram showing structure of an image forming apparatus relating to a present exemplary embodiment.

-Structure of an Image Forming Device Relating to the Present Exemplary Embodiment- Firstly, structure of an image forming apparatus relating to the present exemplary embodiment will be described. FIG. 1 is a schematic diagram showing the structure of the image forming apparatus relating to the present exemplary embodiment.

An image forming apparatus 100 relating to the present exemplary embodiment is provided with an image recording device 110, which records an image on a recording medium P such as paper or the like, and an image reading device 10, which conveys an original and reads an image of the original.

The image reading device 10 is disposed at an upper portion of the image forming apparatus 100, and the image recording device 110 is disposed at a lower portion of the image forming apparatus 100.

The image reading device 10 reads an image of an original and converts the acquired image to image signals. The image recording device 110 records an image onto the recording medium P on the basis of the image signals that have been converted by the image reading device 10.

Now, structure of the image recording device 110 relating to the present exemplary embodiment will be described.

As shown in FIG. 1, the image recording device 110 relating to the present exemplary embodiment is provided, at a lower portion thereof, with a plurality of recording medium accommodation portions 120 and 121, which accommodate recording mediums P.

The recording medium accommodation portions 120 and 121 accommodate recording mediums P of respectively different sizes. For example, the recording medium accommodation portion 120 accommodates B5-size recording mediums P and the recording medium accommodation portion 121 accommodates B4-size recording mediums P.

Feeding rollers 126 are disposed directly above leading end sides (right end sides in FIG. 1) of the recording medium accommodation portions 120 and 121. The feeding rollers 126 touch against leading end sides of upper faces of the recording mediums P and rotate, and feed the recording mediums P out from the recording medium accommodation portions 120 and 121.

In the image recording device 110, a conveyance path 122 is formed which extends from leading end portions of the recording medium accommodation portions 120 and 121, curves in an S shape, and extends toward an upper portion of the image recording device 110.

A plurality (for example, six) of conveyance roller pairs 164, which nip and convey a recording medium P, and a registration roller 168 are arranged along the conveyance path 122 in this order from an upstream side of a conveyance direction of the recording medium.

An image forming section 130, which records an image onto a recording medium P, is disposed upward of the recording medium accommodation portion 121.

A recording medium P accommodated in the recording medium accommodation portion 120 or 121 is fed out by the feeding roller 126, conveyed along the conveyance path 122 by the conveyance roller pairs 164 and the registration roller 168, and fed into the image forming section 130.

The image forming section 130 forms a color image on the recording medium P that has been fed thereto from the recording medium accommodation portion 120 or 121, using toners of the colors cyan, magenta, yellow and black.

In the image forming section 130, four photosensitive drums 112 are rotatably provided in a row. Each photosensitive drum 112 is turned in the direction of arrow K by an unillustrated driving section.

A charging roller 114 is provided diagonally downward to the left of each photosensitive drum 112, so as to touch against the photosensitive drum 112. The charging roller 114 electrostatically charges a surface of the photosensitive drum 112 to a predetermined potential.

Subsequent to the charging, exposure is implemented with light emitted from a respective exposure head 116, which is disposed below the respective photosensitive drum 112. Thus, a latent image corresponding to image signals converted by the image reading device 10 is formed on the surface of the photosensitive drum 112.

A developing unit 118 corresponding to a respective color is disposed diagonally downward to the right of the respective photosensitive drum 112. Toner of the respective color, which has been charged to a predetermined polarity, is retained on a developing roller 119 of the developing unit 118. The latent image that has been formed at the surface of the photosensitive drum 112 is developed by application of a developing bias to the developing roller 119, and a toner image of the respective color is formed.

The toner images of the respective colors that have been formed on the four photosensitive drums 112 are transferred onto an intermediate transfer belt 113, which is disposed upward of the photosensitive drums 112, by first transfer rollers 115, being superposed on the intermediate transfer belt 113 to form a full-color toner image.

The recording medium P that has been fed out from the recording medium accommodation portion 120 or 121 and conveyed by the conveyance roller pairs 164 is fed, with a predetermined timing according to the registration roller 168, between a second transfer roller 132 and an intermediate transfer roller 134, and the full-color toner image is transferred onto the recording medium P. Thus, the toner image is transferred onto a surface of the recording medium P at a side thereof at which the intermediate transfer roller 134 is disposed.

The recording medium P onto which the full-color toner image has been transferred is fed to a fixing unit 136. The fixing unit 136 fixes the toner image to the recording medium P with heat and pressure. The recording medium P to which the toner image has been fixed is ejected by an ejection roller 142 to an ejection tray 140.

The toner image is not completely transferred to the intermediate transfer belt 113 and the recording medium P; a portion remains as residual toner on the photosensitive drums 112 and the intermediate transfer belt 113. Residual toner on the photosensitive drums 112 is removed by cleaning rollers 144, and residual toner on the intermediate transfer belt 113 is removed by a cleaning device 138.

-Structure of an Image Reading Device Relating to the Present Exemplary Embodiment- Next, structure of the image reading device relating to the present exemplary embodiment will be described.

As shown in FIG. 1, the image reading device 10 relating to the present exemplary embodiment is provided with an original conveyance device 20, which conveys an original G and serves as an example of a sheet conveyance device.

Herein, the sheet conveyance device is not limited to an device that conveys an original which is an object of image acquisition, and may be, for example, an device that conveys a recording medium at which an image is to be recorded. Moreover, the sheet conveyance device is not limited in purpose to reading of images, recording of images and the like, and may be a sheet conveyance device that conveys a sheet with another objective, and may further be a sheet conveyance device that conveys a sheet with the objective simply being conveyance of the sheet.

Moreover, a sheet that is conveyed by the sheet conveyance device is not limited to paper, and may be a plastic film or another sheet-form object.

The image reading device 10 relating to the present exemplary embodiment is provided with an image reading section 30, which reads an image on the original G that is conveyed by the original conveyance device 20. The original conveyance device 20 is provided at an upper portion of the image reading device 10, and the image reading section 30 is provided at a lower portion of the image reading device 10.

The image reading section 30 is provided with an image input section 36, a focus optical system 34 and an image reading element 38. The image input section 36 includes a light source 35 and an optical system with mirrors or the like. The focus optical system 34 is formed with a focusing lens or the like. The image reading element 38 is formed of a CCD or the like.

The image input section 36 is formed such that light from the light source 35 is illuminated onto the original G. The light illuminated from the light source 35 is reflected by the original G. Reflected light from the original G is incident on the image input section 36. The light that is incident at the image input section 36 is guided into the focus optical system 34, by the optical system with mirrors and the like of the image input section 36.

The light that has been guided to the focus optical system 34 is focused by the focus optical system 34 and focused at the image reading element 38. The light that has been focused at the image reading element 38 is read by the image reading element 38.

The original conveyance device 20 relating to the present exemplary embodiment is further provided with an tray 11, at which a plurality of the original G can be accommodated, and which serves as an example of a sheet accommodation portion capable of accommodating a plurality of sheets. The tray 11 can be raised and lowered by an unillustrated raising/lowering mechanism.

A feeding roller 13 is disposed directly above a leading end side (the left side in FIG. 1) of the tray 11. The feeding roller 13 touches against the leading end side of an upper surface of an original G and rotates, and feeds the original G out from the tray 11.

In the original conveyance device 20, a conveyance path 22 is formed which extends from a leading end portion of the tray 11 and curves in a C shape. The conveyance path 22 is formed by an upper side conveyance path face 22A and a lower side conveyance path face 22B.

A conveyance roller 14 is disposed above the conveyance path 22, at an original conveyance direction downstream side of the feeding roller 13. The conveyance roller 14 conveys the original G that is fed from the tray 11 to a downstream side in the conveyance direction. The conveyance roller 14 is disposed at an upper side of the conveyance path 22, and is disposed at the conveyance path face 22A such that a portion of the conveyance roller 14 protrudes from the conveyance path face 22A.

A separating roller 15 is disposed at the original conveyance direction downstream side of the feeding roller 13, at the lower side of the conveyance path 22. The separating roller 15 opposes the conveyance roller 14 at a position below the conveyance roller 14. The separating roller 15 touches against the conveyance roller 14 and forms a nipping portion N, at which the original G fed from the tray 11 is nipped between the conveyance roller 14 and the separating roller 15.

The conveyance roller 14 has an axial direction along a direction intersecting the original conveyance direction and rotates around this axis, and rotation driving thereof is controlled by a driving control section (not shown). The conveyance roller 14 touches against an upper face (surface) of the original G that has been fed from the tray 11 and into the nipping portion N, and is driven to rotate, and thus conveys the original G downstream.

A torque limiter (not shown) is attached to a rotation axle of the separating roller 15. Consequently, when a one-sheet original G is introduced to the nipping portion N and the one-sheet original G is conveyed by the conveyance roller 14, the separating roller 15 receives a torque at or above a predetermined value from the original G, and the separating roller 15 rotates passively with the original G by operation of the torque limiter.

If a plurality of originals G are overlappingly fed from the original tray 11 to the nipping portion N, the conveyance roller 14 applies a conveyance force to an original G at the upper side (a first original G), while lower side original(s) G (a second and subsequent original G) are subjected to conveyance resistance from the separating roller 15. That is, the overlapping originals G are separated (processed) into individual sheets by the conveyance roller 14 and separating roller 15, the originals G are supplied, and overlapped feeding of the originals G is suppressed.

Here, the separating roller 15 relating to the present exemplary embodiment is structured by a passive roller that passively rotates without driving force being applied. However, the separating roller 15 may be structured by a driving roller to which driving force is applied.

Further along the conveyance path 22, plural conveyance roller pairs 28 which nip and convey the original G are provided along the conveyance path 22.

An original G that is nipped and conveyed by the plural conveyance roller pairs 28 is temporarily fed out from the original conveyance device 20 and nipped between the original conveyance device 20 and a reading window portion 42 of the image reading section 30. Then, the original G is fed back into the original conveyance device 20 by an original scooping member 40, which is provided at the image reading section 30 and has a triangular shape in cross-section.

The original G that has re-entered the original conveyance device 20 is conveyed by the conveyance roller pairs 28, and then ejected to an ejection tray 19 by an ejection roller pair 29.

When an image of an original G that is being conveyed by the conveyance roller pairs 28 is to be read, the image input section 36 moves to below the reading window portion 42, and an image of the original G passing above the reading window portion 42 is read by the image reading element 38, via the image input section 36 and the focus optical system 34.

The image reading section 30 is also formed with a platen 32 formed of glass or the like, on an upper surface of which the original G is placed.

The original conveyance device 20 is attached to the image reading section 30, to be capable of opening and closing. The original conveyance device 20 also functions as a holding cover that presses on an original G that has been placed on the platen 32. That is, the original conveyance device 20 is opened up from the image reading section 30, an original G is placed on the platen 32, and the original conveyance device 20 is closed and presses on the original G. Here, the original G is placed with an image face to the platen 32 side thereof (i.e., facing downward).

When an image of an original G is to be read, the image of the original G placed on the platen 32 is read by the image reading element 38, via the image input section 36 and the focus optical system 34, with the image input section 36 moving in a horizontal direction.

-Structure for Removing the Feeding Roller 13 and the Conveyance Roller 14 from the Original Conveyance Apparatus 20-

Next, a structure for installing/removing the feeding roller 13 and the conveyance roller 14 to/from the original conveyance device 20 will be described.

Figure 2:
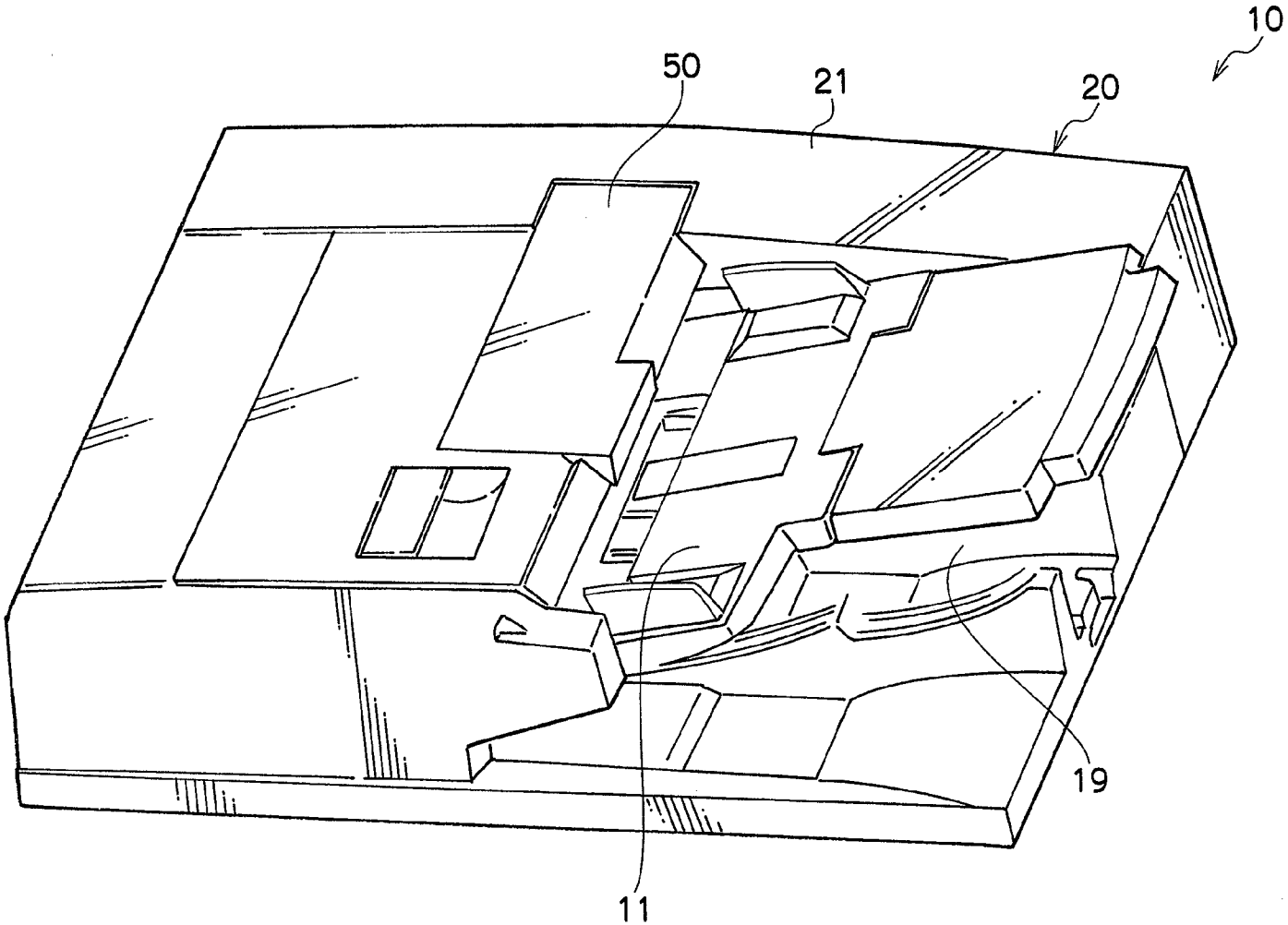
FIG. 2 is a perspective view showing structure of an original conveyance device of an image reading device, being a perspective view showing the original conveyance device in a closed state in which a cover body is closed.
Figure 3:
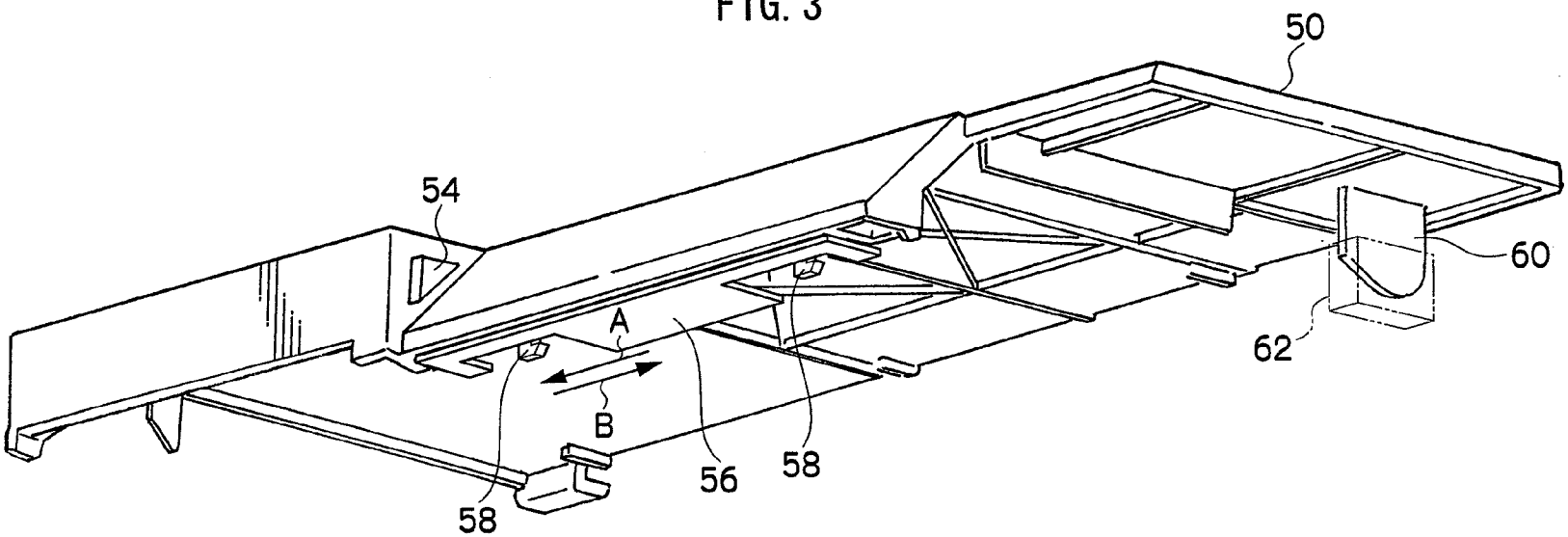
FIG. 3 is a perspective view showing structure of the cover body.
Figure 4:
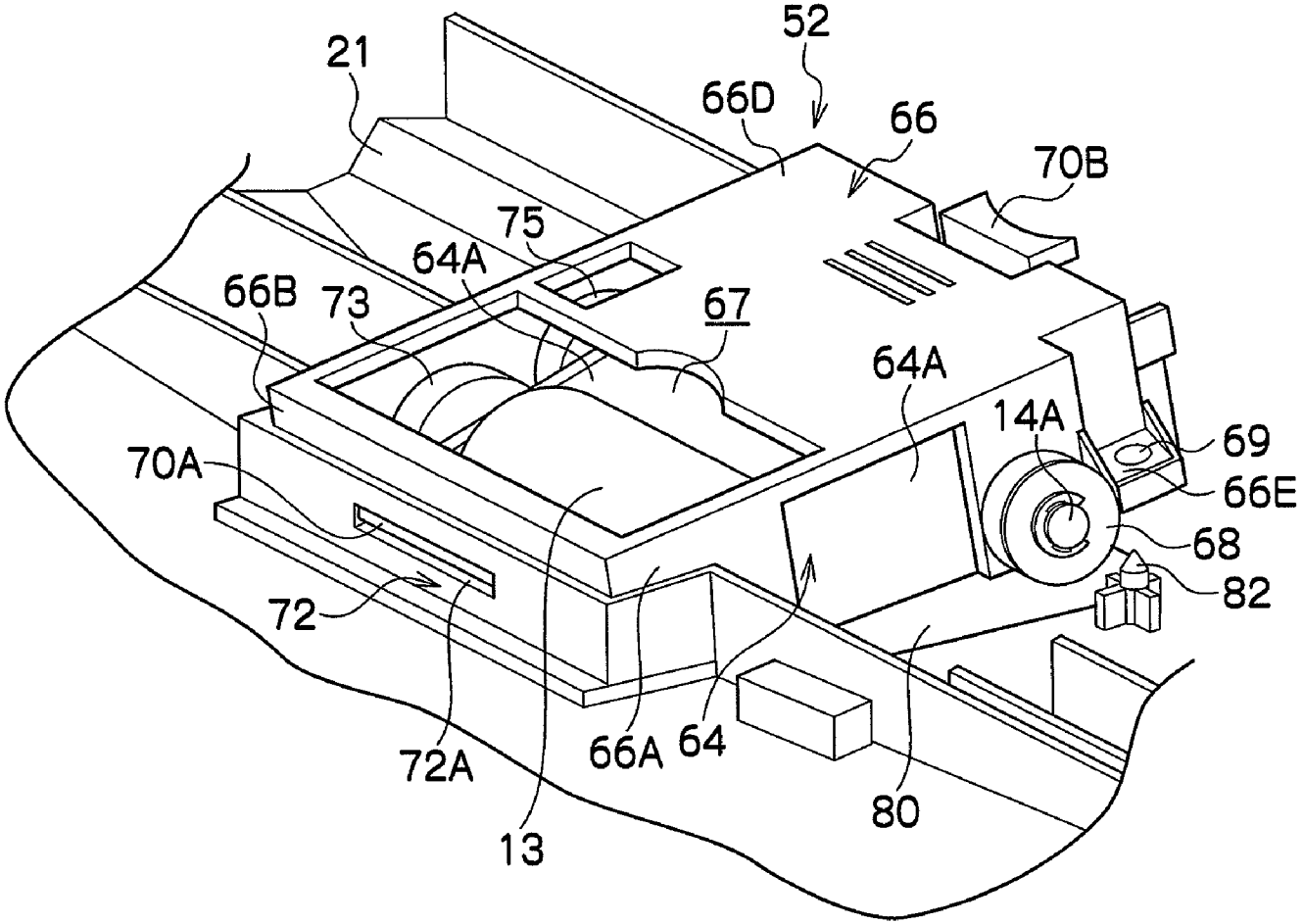
FIG. 4 is a perspective view showing a magnified portion of an upper portion of the original conveyance device in an open state in which the cover body is opened.
Figure 5:
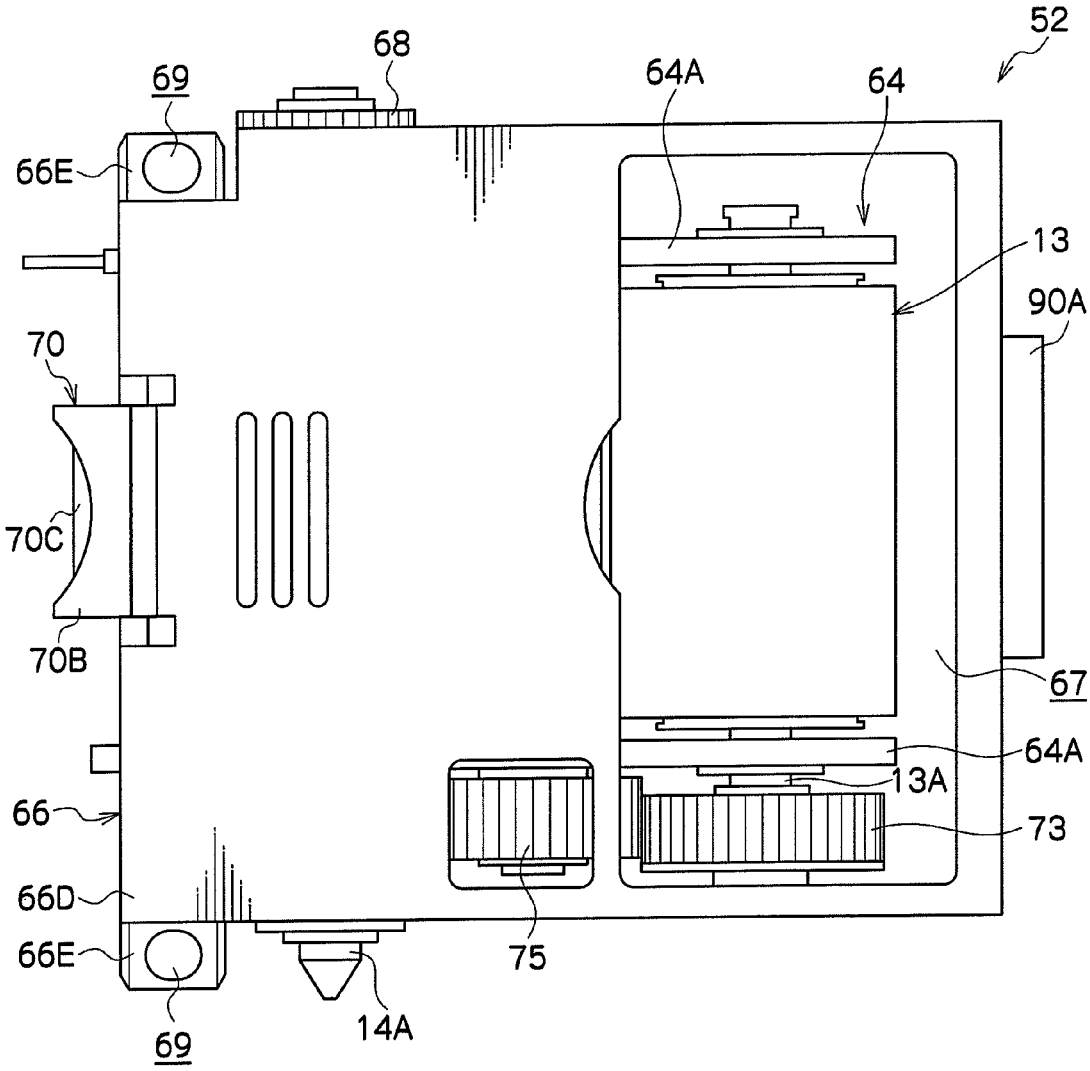
FIG. 5 is a plan view showing structure of a replaceable unit.
Figure 6:
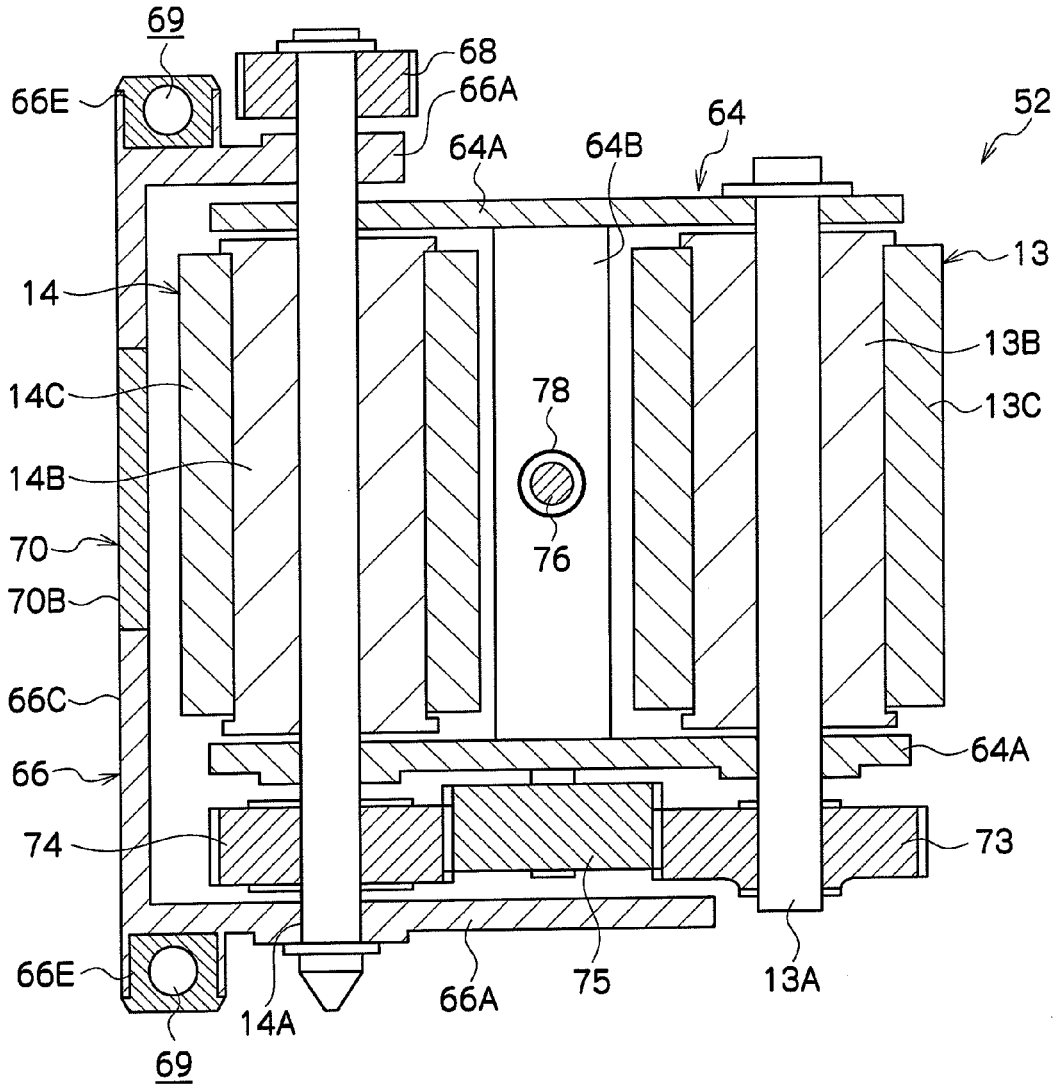
FIG. 6 is a plan view showing a cross-section of a portion of the structure of the replaceable unit.
Figure 7:
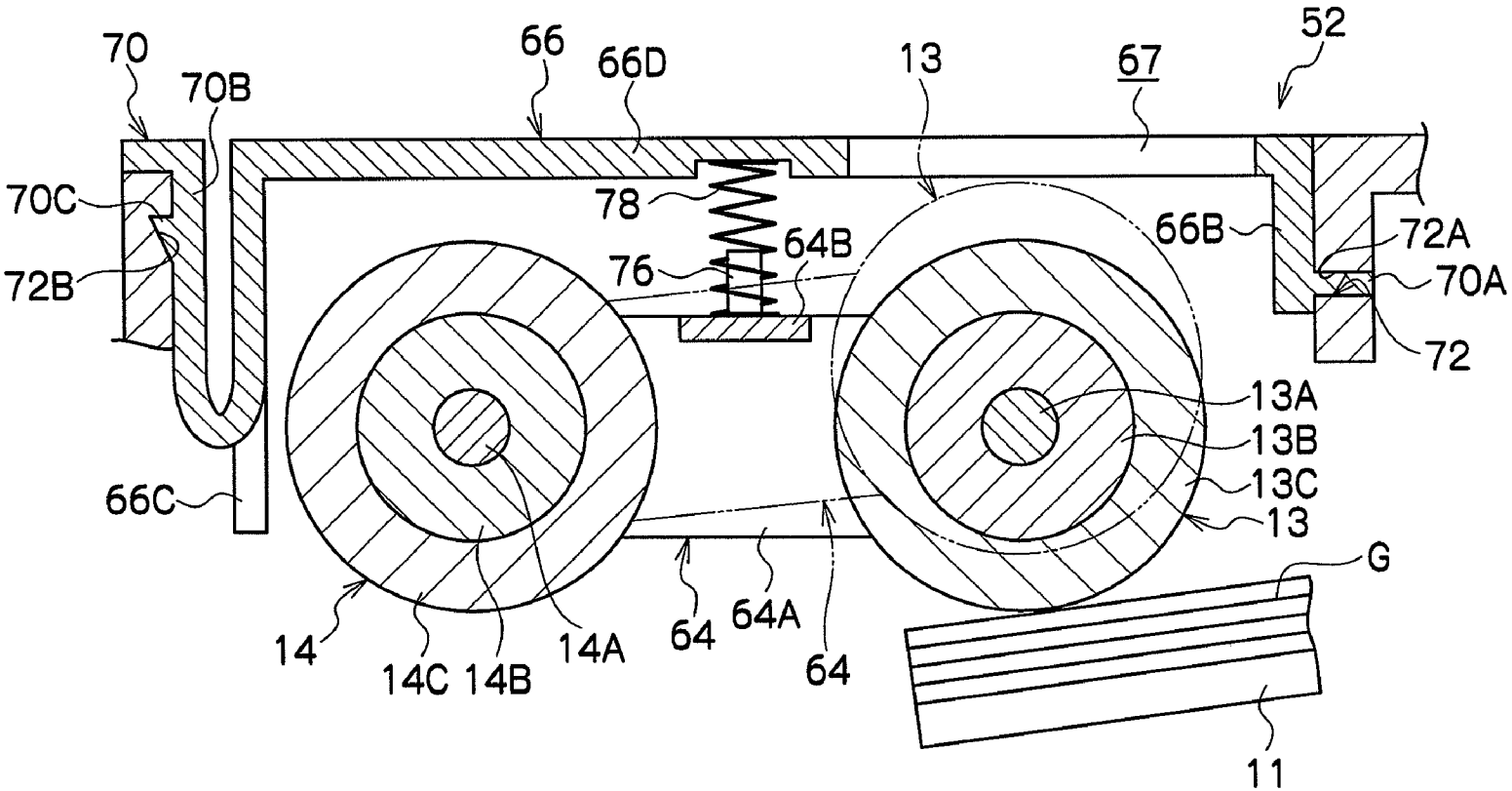
FIG. 7 is a side view of a cross-section of a portion of the structure of the replaceable unit.

FIG. 2 is a perspective view showing structure of the original conveyance device of the image reading device, and is a perspective view showing the original conveyance device in a closed state in which a cover body is closed. FIG. 3 is a perspective view showing structure of the cover body. FIG. 4 is a perspective view showing a magnified portion of an upper portion of the original conveyance device in an open state in which the cover body is opened. FIG. 5 is a plan view showing structure of a replaceable unit. FIG. 6 is a plan view showing a cross-section of a portion of the structure of the replaceable unit. FIG. 7 is a side view of a cross-section of a portion of the structure of the replaceable unit.

As shown in FIG. 1 and FIG. 2, the original conveyance device 20 is provided with an original conveyance device main body 21, which serves as an example of a sheet conveyance device main body, and a cover body 50, which is provided at the original conveyance device main body 21 to be capable of opening and closing.

As shown in FIG. 4, a replaceable unit 52 is provided at the original conveyance device main body 21. The replaceable unit 52 is equipped with the feeding roller 13 and the conveyance roller 14.

The cover body 50 is openably/closeably attached to the original conveyance device main body 21, and opens and closes by turning relative to the original conveyance device main body 21.

The cover body 50 is for covering the replaceable unit 52. In the closed state in which the cover body 50 is closed, the cover body 50 covers over an upper portion of the replaceable unit 52. The cover body 50 is also for exposing the upper portion of the replaceable unit 52. In the open state in which the cover body 50 is opened, the upper portion of the replaceable unit 52 is exposed.

As shown in FIG. 3, the cover body 50 is provided with a push button 54, which is an example of an operation portion. The cover body 50 is also provided with a slider 56, which is connected with the push button 54 and slidingly moves in direction A of FIG. 3 in conjunction with the push button 54 being pressed.

A pawl piece 58, which catches against the original conveyance device main body 21, is formed at the slider 56. The slider 56 is urged in direction B of FIG. 3 by an urging member such as a spring or the like. In the closed state in which the cover body 50 is closed, the pawl piece 58 catches against the original conveyance device main body 21, and thus the cover body 50 is fixed to the original conveyance device main body 21.

When the push button 54 is pushed, the slider 56 slides in direction A of FIG. 3, the catching of the pawl piece 58 against the original conveyance device main body 21 is released, and the cover body 50 is enabled to open from the original conveyance device main body 21.

When the cover body 50 is turned to open up from the original conveyance device main body 21, the replaceable unit 52 that was covered up by the cover body 50 is exposed, as shown in FIG. 4, and access to the replaceable unit 52 is enabled.

A protruding portion 60 is also formed at the cover body 50, at an inner face thereof. The protruding portion 60 protrudes toward the original conveyance device main body 21. The protruding portion 60 is formed so as to turn an interlock switch 62 provided at the original conveyance device main body 21 on and off.

In the present exemplary embodiment, in the closed state in which the cover body 50 is closed, the interlock switch 62 is turned on by an action of the protruding portion 60. The interlock switch 62 is turned on by, for example, the protruding portion 60 pushing the interlock switch 62.

Further, in the present exemplary embodiment, in the open state in which the cover body 50 is opened, the interlock switch 62 is turned off by an action of the protruding portion 60. The interlock switch 62 is turned off by, for example, the state in which the protruding portion 60 pushes the interlock switch 62 being released.

When the interlock switch 62 is turned off, a supply of electricity to a driving motor is turned off, and the driving motor stops. Hence, the replaceable unit 52 can be accessed in a safe condition.

Now, structure of the replaceable unit 52 relating to the present exemplary embodiment will be described.

As shown in FIG. 4, FIG. 5, FIG. 6, and FIG. 7, the replaceable unit 52 is provided with the feeding roller 13, the conveyance roller 14, a first frame body 64 and a second frame body 66. The feeding roller 13 and the conveyance roller 14are rotatably supported with the first frame body 64. The first frame body 64 is rotatably supported with the second frame body 66. The second frame body 66 is removably mounted at a position at which the feeding roller 13 can touch against an original G accommodated at the tray 11.

As shown in FIG. 6, the first frame body 64 is provided with a pair of side plates 64A and a connection portion 64B. The side plates 64A are respectively disposed at outer sides of the two axial direction ends of the feeding roller 13 and the conveyance roller 14. The connection portion 64B is provided between the pair of side plates 64A and is joined with each of the pair of side plates 64A.

The connection portion 64B is disposed between the feeding roller 13 and the conveyance roller 14, and is provided extending along the axial direction of the feeding roller 13 and the conveyance roller 14.

A rotation axle 13A of the feeding roller 13 and a rotation axle 14A of the conveyance roller 14 are each rotatably attached to the pair of side plates 64A. Thus, the feeding roller 13 and the conveyance roller 14 are rotatably supported at the pair of side plates 64A.

The feeding roller 13 is structured to include a rotating body 13B, which is fixed to the rotation axle 13A, and a roller body 13C, which is attached to an outer periphery of the rotating body 13B. Similarly to the feeding roller 13, the conveyance roller 14 is structured to include a rotating body 14B, which is fixed to the rotation axle 14A, and a roller body 14C, which is attached to an outer periphery of the rotating body 14B. The roller body 13C and the roller body 14C are structured of, for example, rubber.

A gear 73 is fixed at one end portion of the rotation axle 13A of the feeding roller 13. A gear 74 is fixed at one end portion of the rotation axle 14A of the conveyance roller 14.

A gear 75, which meshes with the gear 73 and the gear 74, is rotatably supported at the side plate 64A. A driving gear 68 is fixed to an other end portion of the rotation axle 14A of the conveyance roller 14. The driving gear 68 meshes with a gear of a driving section such as the driving motor or the like (not shown), and applies driving force from the driving section.

Thus, the conveyance roller 14 is provided with driving force, via the driving gear 68, and rotates. In this structure, the driving force is further propagated through the gear 74, the gear 75 and the gear 73 to the feeding roller 13, and the feeding roller 13 rotates.

As shown in FIG. 6 and FIG. 7, the second frame body 66 is provided with a pair of side plates 66A, an upstream side plate 66B, a downstream side plate 66C and a top plate 66D. The side plates 66A are respectively disposed at outer sides of the two axial direction ends of the feeding roller 13 and the conveyance roller 14. The upstream side plate 66B is disposed at a conveyance direction upstream side of the feeding roller 13. The downstream side plate 66C is disposed at a conveyance direction downstream side of the conveyance roller 14. The top plate 66D is disposed above the conveyance roller 14. Above the feeding roller 13, an opening 67 is formed in the top plate 66D.

The pair of side plates 66A are respectively disposed at outer sides (outer face sides) of the side plates 64A of the first frame body 64. One of the side plates 66A is disposed between the side plate 64A and the driving gear 68, and the other of the side plates 66A is disposed at the outer side of the gear 74.

Thus, as shown in FIG. 6, at one end of the rotation axle 14A of the conveyance roller 14, the side plate 64A of the first frame body 64, the side plate 66A of the second frame body 66, and the driving gear 68 are provided in this order toward the outer side in the axial direction of the conveyance roller 14, and at the other end, the side plate 64A of the first frame body 64, the gear 74, and the side plate 66A of the second frame body 66 are provided in this order.

The rotation axle 14A of the conveyance roller 14 is rotatably attached to each of the pair of side plates 66A. Thus, the conveyance roller 14 is rotatably supported by the side plates 66A.

Therefore, the first frame body 64 is supported at the rotation axis of the conveyance roller 14 to be capable of swinging relative to the second frame body 66, with the rotation axle 14A of the conveyance roller 14 serving as a center of swinging. Thus, the first frame body 64 is movably supported by the second frame body 66.

As shown in FIG. 7, the first frame body 64 is capable of swinging in a direction in which the feeding roller 13 touches against an original G accommodated at the tray 11, and in a direction of moving away from the original G. In FIG. 7, the feeding roller 13 illustrated with solid lines indicates the feeding roller 13 at a contact position at which the feeding roller 13 touches against the original G accommodated at the tray 11, and the feeding roller 13 drawn with broken lines indicates the feeding roller 13 at a separated position at which the feeding roller 13 has moved away from the original G accommodated at the tray 11.

A compression spring 78 is disposed between the top plate 66D of the second frame body 66 and the connection portion 64B of the first frame body 64. The compression spring 78 is an example of pushing portion, which pushes the first frame body 64 in the direction in which the feeding roller 13 touches against the original G accommodated at the tray 11.

The pushing portion is not limited to the compression spring 78. A spring such as a torsion spring, a plate spring or the like, a resilient member of rubber or the like, or another portion capable of pushing may be employed.

A mounting portion 76, at which the compression spring 78 is mounted, is provided at a central portion of the connection portion 64B in a length direction (i.e., the axial direction of the feeding roller 13 and the conveyance roller 14). The mounting portion 76 is formed by a circular rod-form protruding portion, and is inserted into the coil-form compression spring 78 to mount the compression spring 78.

One end portion of the compression spring 78 sits against an inner wall of the top plate 66D, and another end portion of the compression spring 78 sits against an upper face of the connection portion 64B. As a result, the first frame body 64 is urged in the direction for the feeding roller 13 to touch against the original G accommodated at the tray 11.

A mounting mechanism 70 is provided at the upstream side plate 66B and the downstream side plate 66C, for removably mounting the second frame body 66 to the original conveyance device main body 21.

The mounting mechanism 70 is provided with a protruding portion 70A, which protrudes to the upstream side from the upstream side plate 66B, and a snap fitting 70B, which is an example of a fixing member that fixes the second frame body 66 in removable state.

The snap fitting 70B is provided with a resilient piece, which is urged to the conveyance direction downstream side, and a pawl portion 70C which is formed at the snap fitting 70B.

It is possible to use various structures as the fixing member. For example, a structure is possible in which a slider is provided at the second frame body 66, which slidingly moves and engages with the original conveyance device main body 21 to fix the second frame body 66.

A mounting portion 72, corresponding with the mounting mechanism 70 of the second frame body 66, is provided at the original conveyance device main body 21. The second frame body 66 is removably mounted at the original conveyance device main body 21.

The mounting portion 72 of the original conveyance device main body 21 is provided with a slit 72A, into which the protruding portion 70A is inserted, and a groove portion 72B, against which the pawl portion 70C catches.

Accordingly, when the protruding portion 70A of the second frame body 66 is inserted into the slit 72A at the original conveyance device main body 21 and then the second frame body 66 is pressed in toward the original conveyance device main body 21, the snap fitting 70B resiliently deforms and the pawl portion 70C of the snap fitting 70B catches in the groove portion 72B of the original conveyance device main body 21, and thus the second frame body 66 is mounted to the mounting portion 72 of the original conveyance device main body 21.

The mounting portion 72 of the original conveyance device main body 21 is provided at a rear face (opposite face) side of the conveyance path face 22A. Thus, The replaceable unit 52 is a structure which is removed in a direction away from the conveyance path face 22A (i.e., upward in the present exemplary embodiment).

As shown in FIG. 4, an aperture 80 is formed in the original conveyance device main body 21, for exposing the feeding roller 13 and the conveyance roller 14 at the side of the original conveyance device main body 21 at which the conveyance path face 22A is provided, and the second frame body 66 is removably mounted at a position at which the feeding roller 13 can touch against an original G accommodated at the tray 11.

A protruding piece 66E is formed at an outer face of each side plate 66A. Each protruding piece 66E protrudes to the outer side in the axial direction of the conveyance roller 14 from a position at the conveyance direction downstream side of the side plate 66A. A positioning hole 69 is formed in the protruding piece 66E.

Correspondingly, a projection 82, which is inserted into the positioning hole 69, is formed at the original conveyance device main body 21. The projection 82 is provided at the original conveyance device main body 21 from the conveyance path face 22A, and protrudes upward. When these projections 82 are inserted into the positioning holes 69, the second frame body 66 is positioned at the mounting portion 72 of the original conveyance device main body 21.

Figure 8:
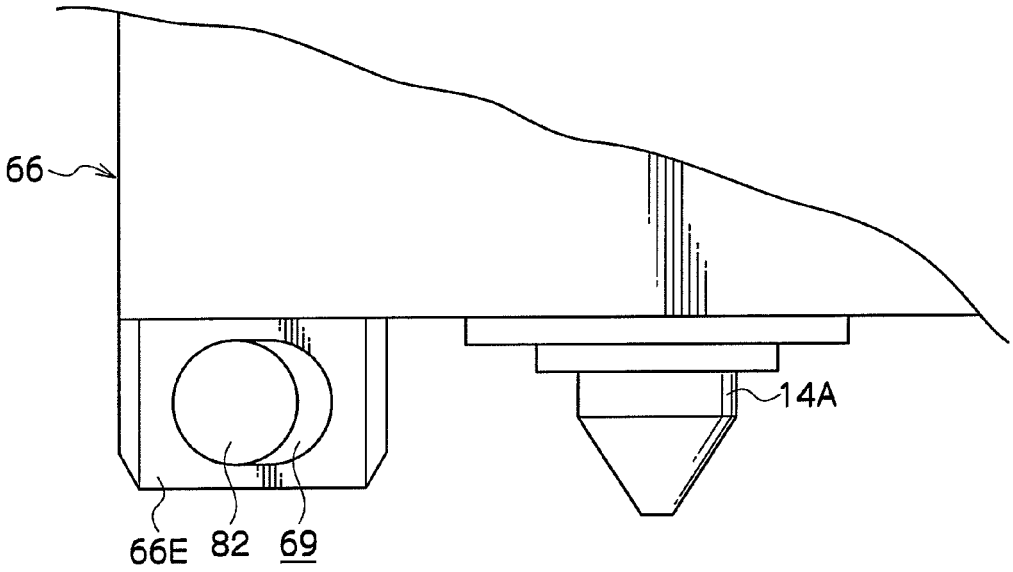
FIG. 8 is an enlarged view in which a region of a protruding piece formed at a second frame body is enlarged.

FIG. 8 is an enlarged view in which a region of the protruding piece 66E formed at the second frame body 66 is enlarged. As shown in FIG. 8, the projection 82 abuts against a conveyance direction downstream side inner edge of the positioning hole 69.

The second frame body 66 receives a force (a reaction force in the conveyance direction upstream direction) of a conveyance force that the conveyance roller 14 applies to the original G, but the second frame body 66 is positioned while the conveyance direction downstream side inner edge of the positioning hole 69 being abutted to the projection 82.

Figure 9:
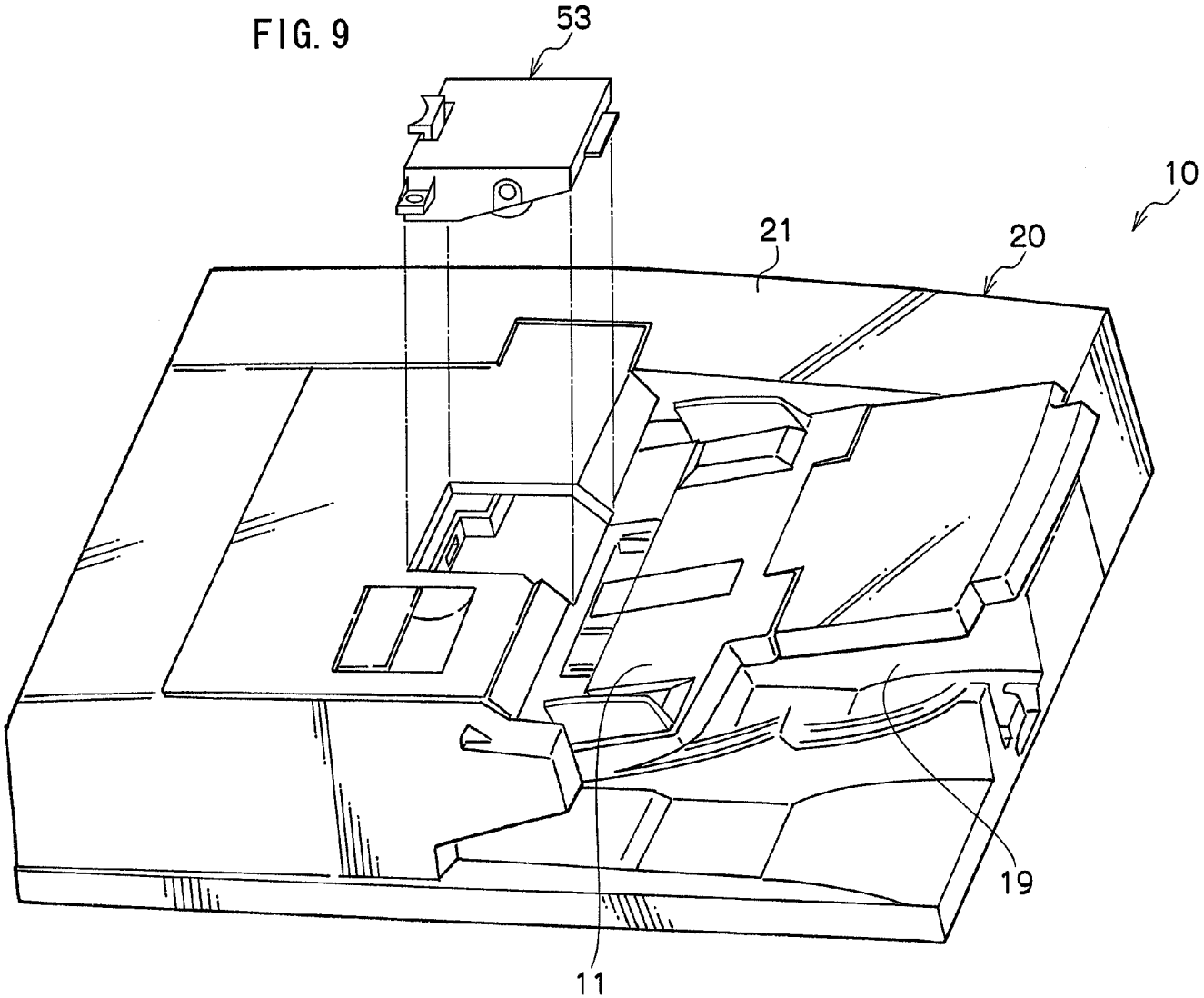
FIG. 9 is a perspective view showing a replaceable unit of which an outer surface also serves as a cover, which is a variant example of the replaceable unit.

Note that the exemplary embodiment described above has a structure in which the cover body 50 which covers the replaceable unit 52 is provided, and the replaceable unit 52 is removed after the cover body 50 has been opened. However, this structure is not limiting. For example, as shown in FIG. 9, a replaceable unit 53 of which an outer surface also serves as a cover is possible. With such a structure, an upper surface of the replaceable unit 53 constitutes a portion of an outer surface of the original conveyance device 20, and a separate cover body that covers the replaceable unit 53 is not required.

-Operation of the Present Exemplary Embodiment-

Next, operation of the exemplary embodiment described above will be described.

In the present exemplary embodiment, when the replaceable unit 52 is to be replaced, first, the cover body 50 is opened and the replaceable unit 52 is exposed as shown in FIG. 4.

The snap fitting 70B is resiliently deformed, the catching against the groove portion 72B of the pawl portion 70C formed at the snap fitting 70B is released, and the replaceable unit 52 is taken out from the mounting portion 72 of the original conveyance device main body 21.

The protruding portion 70A of the second frame body 66 of a new replaceable unit 52 is inserted into the slit 72A of the original conveyance device main body 21, and then the second frame body 66 is pressed in to the original conveyance device main body 21. Accordingly, the snap fitting 70B resiliently deforms, and the pawl portion 70C of the snap fitting 70B catches in the groove portion 72B of the original conveyance device main body 21. Thus, the second frame body 66 is mounted at the mounting portion 72 of the original conveyance device main body 21, and the new replaceable unit 52 is replaced.

In the present exemplary embodiment, when the second frame body 66 is being mounted at the mounting portion 72 of the original conveyance device main body 21, the first frame body 64 is displaced relative to the second frame body 66. Therefore, when the second frame body 66 is being mounted, the first frame body 64 is unlikely to hinder an operation of replacement of the replaceable unit 52, and the replaceable unit 52 can be easily replaced relative to a structure in which the first frame body 64 is not displaced.

Moreover, in the present exemplary embodiment, the compression spring 78 which serves as pushing portion is incorporated in the replaceable unit 52. Therefore, it is not necessary to add separate pushing portion to the replaceable unit 52 or incorporate pushing portion provided at the original conveyance device main body 21. Thus, the operation of replacement of the replaceable unit 52 can be simplified.

In the present exemplary embodiment, the second frame body 66 receives a reaction force from a conveyance force applied to an original G by the conveyance roller 14. However, the second frame body 66 is positioned while abutting in the direction in which the received force acts (the conveyance direction upstream direction). In this situation, the second frame body 66 may be positioned so as not to move in the conveyance direction upstream direction. Therefore, occurrences of looseness of the replaceable unit 52 at times of conveyance of originals G are suppressed, and the replaceable unit can be excellently positioned.

In the present exemplary embodiment, the first frame body 64 is supported at the rotation axis of the conveyance roller 14 to be capable of swinging relative to the second frame body 66, with the rotation axle 14A of the conveyance roller 14 as a center of swinging. Thus, the first frame body 64 can be movably supported with a simple structure.

In the present exemplary embodiment, the replaceable unit 52 is removed in the direction away from the conveyance path face 22A (i.e., upward in the present exemplary embodiment), as shown in FIG. 9. Therefore, in comparison with a structure in which the replaceable unit 52 is replaced by being moved in an axial direction of the feeding roller 13, a space saving for replacement of the replaceable unit 52 can be achieved.

Furthermore, in the present exemplary embodiment, the replaceable unit 52 can be replaced without opening up the conveyance path along which the originals G are conveyed, and operation efficiency of replacement of the replaceable unit 52 are improved.

The present invention is not to be limited to the exemplary embodiments described above, and numerous variations, modifications and improvements are possible. The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the chart. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A replaceable unit comprising:

a feeding roller that feeds a sheet from a sheet accommodation portion that accommodates the sheet;

a conveyance roller that conveys the sheet fed by the feeding roller downstream in a sheet conveyance direction;

a first frame body that supports the feeding roller and the conveyance roller so as to be rotatable; and a second frame body that supports the first frame body so as to be movable and is removably mounted at a position at which the feeding roller can touch against the sheet accommodated at the sheet accommodation portion, wherein a protruding piece, having a positioning hole formed therein, is provided at each side of the second frame body at a downstream side in the sheet conveyance direction of the conveyance roller, and wherein the protruding piece is adapted to have a projection, which is formed at a sheet conveyance device main body, inserted in the positioning hole, whereby the second frame body can move in the sheet conveyance direction.

2. The replaceable unit of claim 1, further comprising a pushing portion disposed between the first frame body and the second frame body, the pushing portion pushing the first frame body in a direction in which the feeding roller touches against the sheet accommodated at the sheet accommodation portion.

3. The replaceable unit of claim 2, wherein the second frame body is configured to be removably mounted to a sheet conveyance device main body, wherein, in operation, the conveyance roller applies a conveyance force to the sheet to convey the sheet and a reaction force to the conveyance force is applied to the second frame body, and wherein the second frame body is configured to be positioned relative to the sheet conveyance device main body so as to abut the sheet conveyance device main body in a direction in which the reaction force is applied to the second frame body.

4. The replaceable unit of claim 2, wherein the first frame body is supported at a rotation axle of the conveyance roller to be capable of swinging relative to the second frame body.

5. The replaceable unit of claim 2, wherein the second frame body is removed in a direction away from a plane of a conveyance path along which the sheet is conveyed.

6. The replaceable unit of claim 1, wherein the second frame body is configured to be removably mounted to a sheet conveyance device main body, wherein, in operation, the conveyance roller applies a conveyance force to the sheet to convey the sheet and a reaction force to the conveyance force is applied to the second frame body, and wherein the second frame body is configured to be positioned relative to the sheet conveyance device main body so as to abut the sheet conveyance device main body in a direction in which the reaction force is applied to the second frame body.

7. The replaceable unit of claim 1, wherein the first frame body is supported at a rotation axle of the conveyance roller to be capable of swinging relative to the second frame body.

8. The replaceable unit of claim 1, wherein the second frame body is removed in a direction away from a plane of a conveyance path along which the sheet is conveyed.

9. A sheet conveyance device comprising:

the replaceable unit of claim 1;

a sheet conveyance device main body, on which the replaceable unit is mounted and in which a conveyance path along which the sheet is conveyed is formed;

the sheet accommodation portion, which is provided on the sheet conveyance device main body; and a cover body provided on the sheet conveyance device main body and being openable in a direction away from a plane of the conveyance path along which the sheet is conveyed, the cover body covering the replaceable unit.

10. The sheet conveyance device of claim 9, wherein, in operation, the conveyance roller applies a conveyance force to the sheet to convey the sheet and a reaction force to the conveyance force is applied to the second frame body, and wherein the second frame body is positioned relative to the sheet conveyance device main body so as to abut the sheet conveyance device main body in a direction in which the reaction force is applied to the second frame body.

11. The sheet conveyance device of claim 9, wherein the replaceable unit is removed in a direction away from the plane of the conveyance path.

12. An image forming apparatus comprising:

the sheet conveyance device of claim 9;

an image reading device including an image reading section that reads an image of the sheet conveyed by the sheet conveyance device; and an image recording device that records an image onto a recording medium on the basis of the image read by the image reading device.

13. The image forming apparatus according to claim 12, wherein, in operation, the conveyance roller applies a conveyance force to the sheet to convey the sheet and a reaction force to the conveyance force is applied to the second frame body, and wherein the second frame body is positioned relative to the sheet conveyance device main body so as to abut the sheet conveyance device main body in a direction in which the reaction force is applied to the second frame body.

14. The image forming apparatus according to claim 12, wherein the replaceable unit is removed in a direction away from the plane of the conveyance path.

15. A replaceable unit comprising:

a feeding roller that feeds a sheet from a sheet accommodation portion that accommodates the sheet;

a conveyance roller that conveys the sheet fed by the feeding roller downstream in a sheet conveyance direction;

a first frame body that supports the feeding roller and the conveyance roller so as to be rotatable;

a second frame body that supports the first frame body so as to be movable and is removably mounted at a position at which the feeding roller can touch against the sheet accommodated at the sheet accommodation portion; and a pressing portion disposed between the first frame body and the second frame body, the pressing portion pressing the first frame body in a direction in which the feeding roller touches against the sheet accommodated at the sheet accommodation portion, wherein the first frame body comprises:

a pair of side plates respectively disposed at outer sides of the two axial direction ends of the feeding roller and the conveyance roller, the feeding roller and the conveyance roller being rotatably supported at the pair of side plates; and a connection portion disposed between the feeding roller and the conveyance roller and provided extending between the pair of side plates, the connection portion being joined with each of the pair of side plates; and wherein the pressing portion is disposed between the second frame body and the connection portion of the first frame body and at a central portion, in an axial direction of the feeding roller and the conveyance roller, of the connection portion, the pressing portion being formed with a resilient member to press the first frame body in a direction in which the feeding roller touches against the sheet accommodated at the sheet accommodation portion.

16. A sheet conveyance device comprising:

the replaceable unit of claim 15;

a sheet conveyance device main body, at which the replaceable unit is mounted and the conveyance path plane is formed;

the sheet accommodation portion, which is provided at the sheet conveyance device main body; and a cover body provided at the sheet conveyance device main body and being openable in an opposite direction of the sheet conveyance device main body with respect to the conveyance path plane, the cover body covering the replaceable unit.

17. An image forming apparatus comprising:

the sheet conveyance device of claim 16;

an image reading device including an image reading section that reads an image of the sheet conveyed by the sheet conveyance device; and an image recording device that records an image onto a recording medium on the basis of the image read by the image reading device.

* * * * *